US005218813A

United States Patent [19]

Seidel

[11] Patent Number: 5,218,813

[45] Date of Patent: Jun. 15, 1993

[54] BUNDLING DEVICE AND METHOD

[75] Inventor: Randy R. Seidel, Bethlehem, Pa.

[73] Assignee: Graphic Management Associates, Inc., Southborough, Mass.

[21] Appl. No.: 690,552

[22] Filed: Apr. 24, 1991

[51] Int. Cl.[5] ..... B65B 13/14; B65B 13/18

[52] U.S. Cl. ..... 53/399; 53/447; 53/535; 53/542; 53/589

[58] Field of Search ..... 53/399, 447, 449, 466, 53/461, 590, 589, 586, 231, 540, 535, 542

[56] References Cited

U.S. PATENT DOCUMENTS

| | | | |
|---|---|---|---|
| 2,768,489 | 10/1956 | Brown, Jr. et al. | 53/590 X |
| 3,040,488 | 6/1962 | Winkler et al. | 53/542 X |
| 3,122,870 | 3/1964 | Stemmler | 53/540 X |
| 3,526,170 | 9/1970 | Oderman et al. | 53/540 X |
| 4,292,785 | 10/1981 | Hammond | 53/589 X |

*Primary Examiner*—James F. Coan

*Attorney, Agent, or Firm*—Jordan B. Bierman

[57] ABSTRACT

A device for bundling a plurality of flat flexible structures received serially from a feed conveyor, applying top and bottom protective sheets, and strapping the structure together. The device includes a support conveyor adjacent to the feed conveyor and movable in a downstream direction along a path, a first conveyor movable in the downstream direction adjacent and substantially parallel to said support conveyor, at least one first blade on the first conveyor movable in a perpendicular direction toward the support conveyor to a support position. The first blade acts as a rest for the structures, and is movable away from the support conveyor to an inoperative position out of the path. When in the support position, this first blade advances in the downstream direction as the structures are deposited on edge onto the support conveyor, whereby a bundle of structures is formed.

45 Claims, 12 Drawing Sheets

FIG. 9B
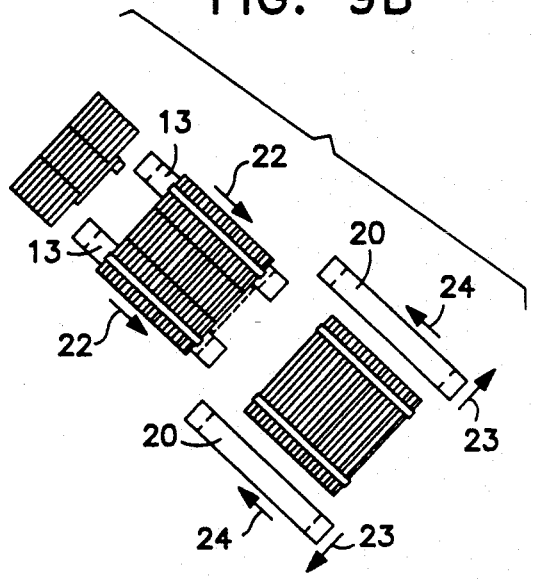
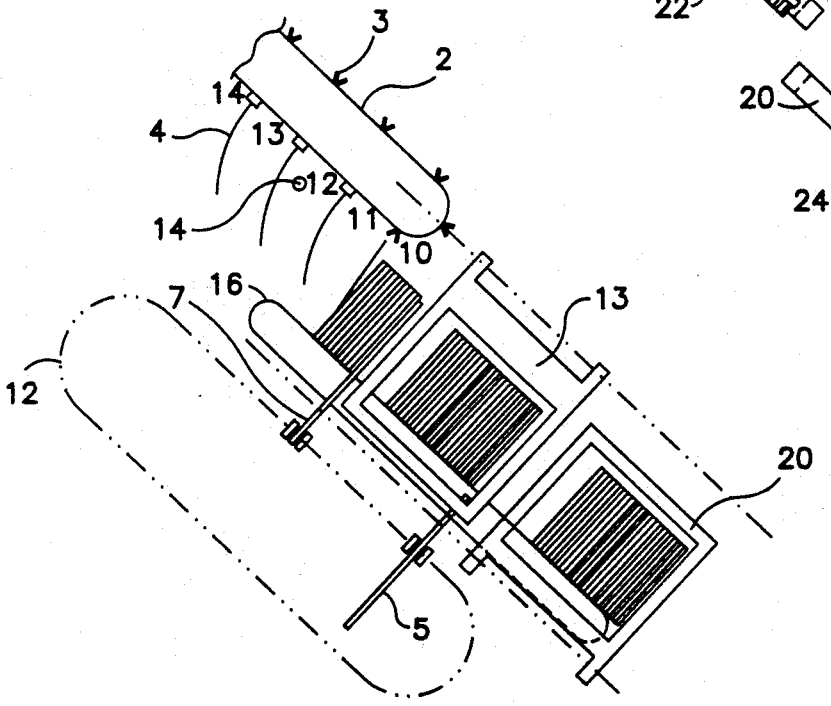
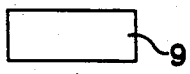
FIG. 9A

BUNDLING DEVICE AND METHOD

The present invention is directed to an improved apparatus and method for receiving a plurality of flat flexible structures, forming them into bundles, and strapping the bundles to form a permanent unit. While the present invention is applicable to flat flexible materials generally, it will be described here in connection with the handling of newspapers. However, the invention is not intended to be limited thereto.

Usually, a newspaper comprises several sections, many of which are printed at different times and in different places. Therefore, it is necessary to insert these inner sections into the news section or jacket. After insertion, the complete newspaper is then conveyed to a bundling device where they are stacked and strapped together.

These devices operate in various ways, but generally are unable to keep up with the flow of newspapers as produced by modern high speed equipment. In this regard, it is an object of the present invention to provide a bundling device adapted to operate at high speeds and which is economical to produce.

BRIEF DESCRIPTION OF THE PRESENT INVENTION

The device comprises a support conveyor adjacent a feed conveyor and movable in a downstream direction along a prescribed path. A first conveyor, movable in the downstream direction, is located adjacent and substantially parallel to the support conveyor.

At least one first blade is on the first conveyor and is movable in a direction perpendicular to the surface of the first conveyor toward the support conveyor to a support position wherein the first blade acts as a rest for the structures being deposited. It also is movable away from the support position out of the path of movement of the structures. When the first blade is in the support position, it advances downstream at substantially the same speed as the structures are deposited on edge onto the support conveyor. As this occurs, a bundle of the structures is formed. In a preferred form of the blades, vacuum suckers are provided on their top and bottom surfaces to retain protective sheets which are inserted at the top and bottom of each bundle.

There is also provided a first pair of strapping frames, one on each side of the bundle. They are movable in the downstream direction from a starting position and in an upstream direction opposite thereto. The frames are also movable in a strapping direction toward the bundle to a strapping position wherein they surround portions of the bundle. When moved away from the strapping position in an opposite direction, they assume an opposite position which is clear of the bundle and out of the path.

Upon completion of the bundle, the first pair of strapping frames moves downstream from their starting position at a speed substantially equal to that of the bundle. At the same time, they move inwardly into the strapping position and wrap a pair of straps around the bundle. Once this operation is complete, they separate clear of the bundle and move upstream to their starting position. The cycle is then repeated for each bundle formed. In this form of the device, it is desirable to provide a plurality of blades on the first conveyor so that the following blade moves into the support position just after the previous bundle has been completed.

In another embodiment of the invention, there are a first conveyor and a second conveyor, operating independently of each other. Each carries one or more blades thereon and they assume the support position alternately and move through the entire cycle in the same way. In this manner, higher speed can be obtained with less movement of the chain conveyors.

In addition, it is possible to control the blades so that they can move slowly when in support position, rapidly when returning to the starting position, and even pause at the starting position or elsewhere if necessary to await the completion of the bundle.

In somewhat similar fashion, a second pair of strapping frames may also be provided. As in the case of the first pair, one is located on each side of the bundle and is movable in the same manner as the first pair. In essence, the first and second pairs of strapping frames operate alternately with each other. As the first is moving downstream with the bundle and fixing the straps thereto, the other is in the separated position and is moving upstream to the initial position. In this way, a high speed productivity is obtained without having to increase the operational speed of the elements of the device.

After the bundles have been strapped, they are ejected from the bundling device to a discharge conveyor to be taken to another location. In this way, a high speed throughput of papers and bundles is achieved, by equipment having elements moving relatively slowly. The device is capable of operating with two types of feed conveyors; i.e. those which hold the folded paper edge and those which hold the open paper edge.

BRIEF DESCRIPTION OF THE DRAWINGS

In the accompanying drawings, constituting a part hereof, and in which like reference characters indicate like parts.

FIGS. 4A & 4B through FIGS. 8A & 8B correspond to FIGS. 3A and 3B, respectively, showing further steps in the sequence of operation;

FIGS. 9A & 9B are similar to FIGS. 3A and 3B showing a second embodiment of the present invention;

DETAILED DESCRIPTION OF THE INVENTION

Figure 1:
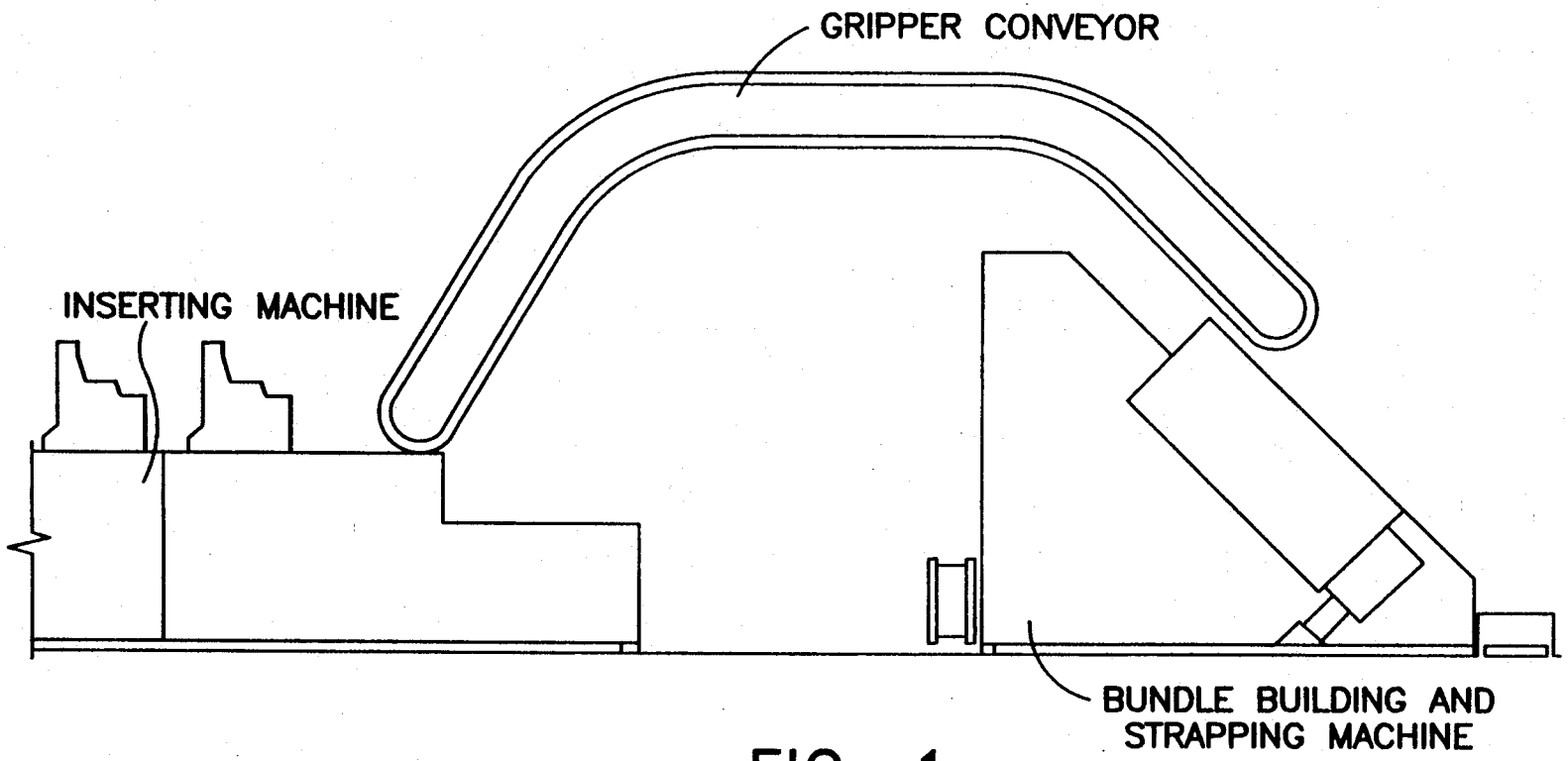
FIG. 1 is an overall schematic elevation showing the relative locations of the bundler, conveyor, and inserter in a typical installation.
Figure 2:
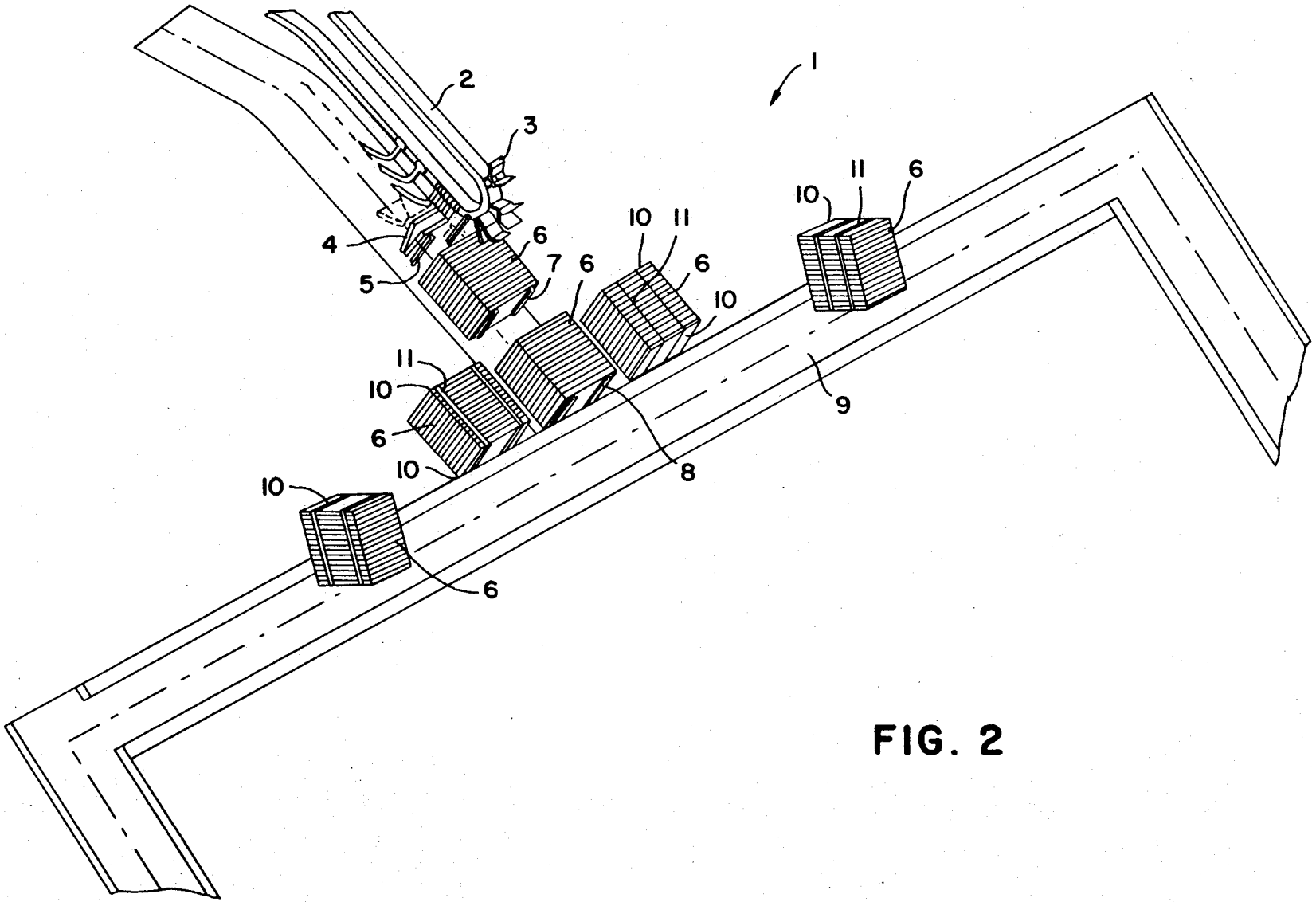
FIG. 2 is an overall schematic view in perspective showing the bundling device of the present invention and associated conveyors, with some parts omitted for clarity.

The broad arrangement of the present invention is best shown in FIG. 2. Bundler 1 comprises feed conveyor 2 having grippers 3 mounted thereon. Papers 4 are held in grippers 3 until they approach the support conveyor. They are deposited on edge and rest against blades 5, 7, and 8. As can be seen from FIG. 2, there are two bundles 6 which have been completed by the device, resting against blades 7 and 8, respectively. When the blades reach the position of blades 8, they are withdrawn from the path of movement of bundles 6 so that bundle 6 can be ejected onto discharge conveyor 9. If necessary, bundle 6 is provided with end covers 10 and held by straps 11.

Figure 3A:
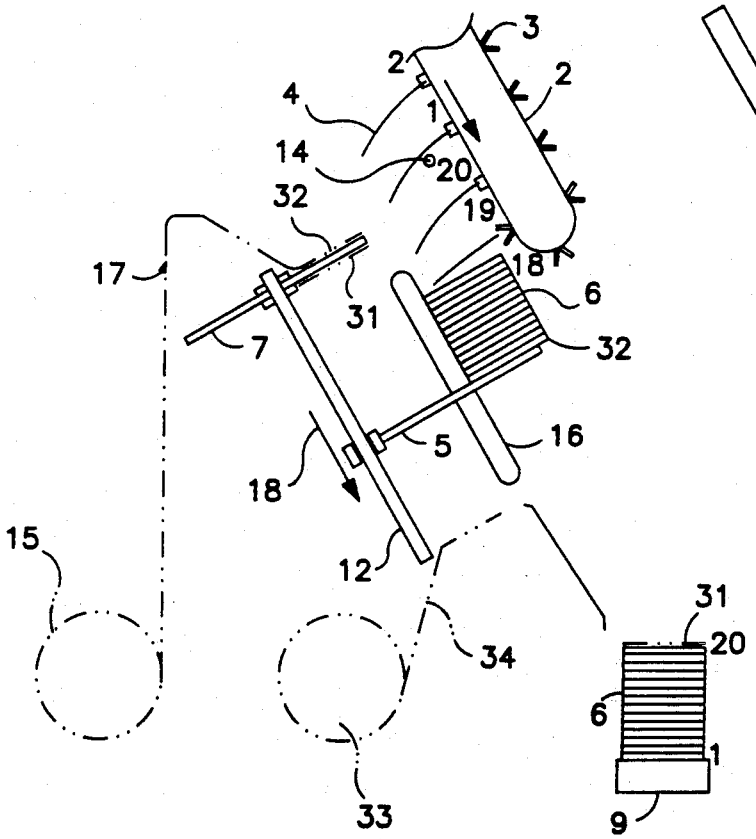
FIG. 3A is a schematic elevation of the first step of a first embodiment of the present invention, wherein the feed conveyor grips the open edge of the papers.
Figure 3B:
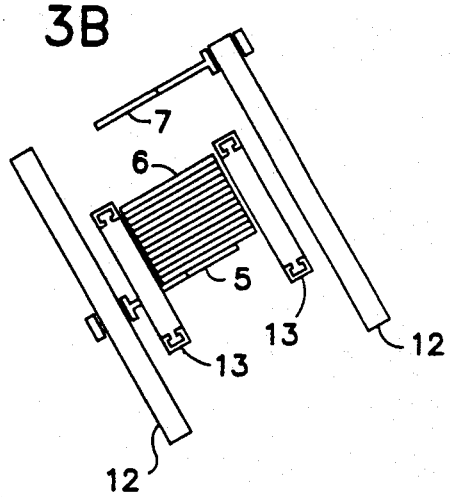
FIG. 3B is a schematic plan view of the device as shown in FIG. 3A, with some parts omitted for clarity.

The invention will be understood more specifically by reference to FIGS. 3A and 3B. Bundler 1 comprises support conveyor 16, first conveyors 12, first blades 5 and second blades 7. Grippers 3 on feed conveyor 2 hold papers 4 by their open edges. As grippers 3 approach support conveyor 16, they open and papers 4 are counted by sensor 14 and dropped on edge onto conveyor 16 to rest against first blades 5.

Second blades 7 (mounted on a second conveyor) have not yet been moved into the support position in which first blades 5 are shown. First roll 15 applies bottom protective sheet 32 to blade 7 via bottom sheet feed 17, and top protective sheet 31 is applied by second roll 33 and top sheet feed 34. Also shown in FIG. 3A is discharge conveyor 9 carrying completed bundle 6. Strapping of the bundle is carried out by strapping frames 13 which, in FIG. 3B, are in their starting position outside bundle 6.

Figure 4A:
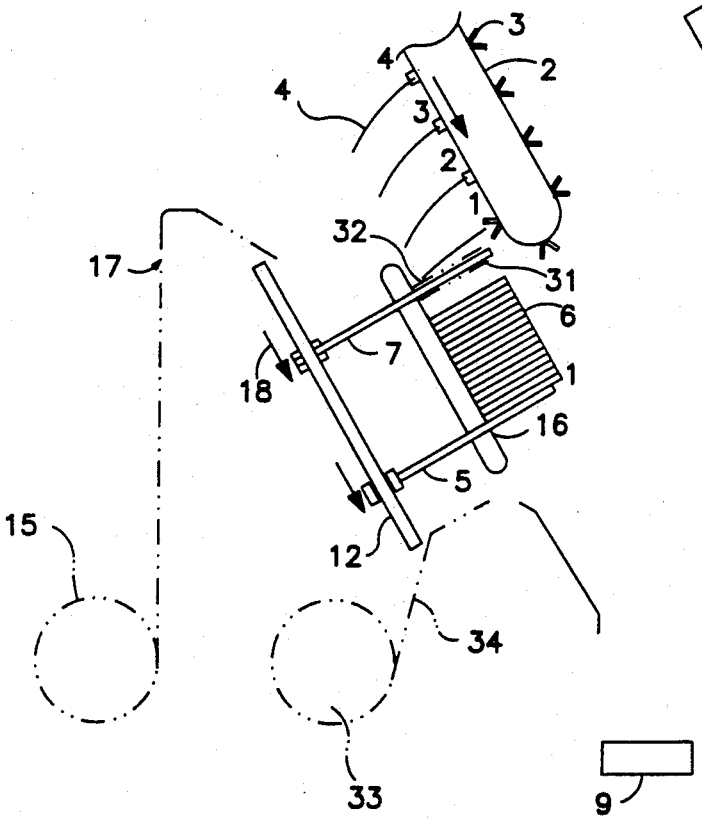
Figure 4B:
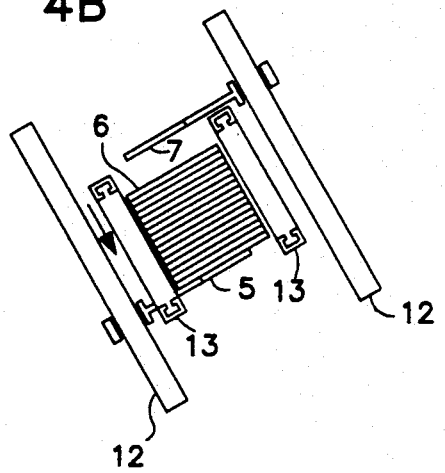

FIGS. 4 to 8 show succeeding steps in the operation of the device of the present invention. In FIGS. 4, bundle 6 has been completed and rests on first blades 5. A new bundle has been begun, resting on second blades 7. As bundle 6 moves downstream, strapping frames 13 move closer to bundle 6.

Figure 5A:
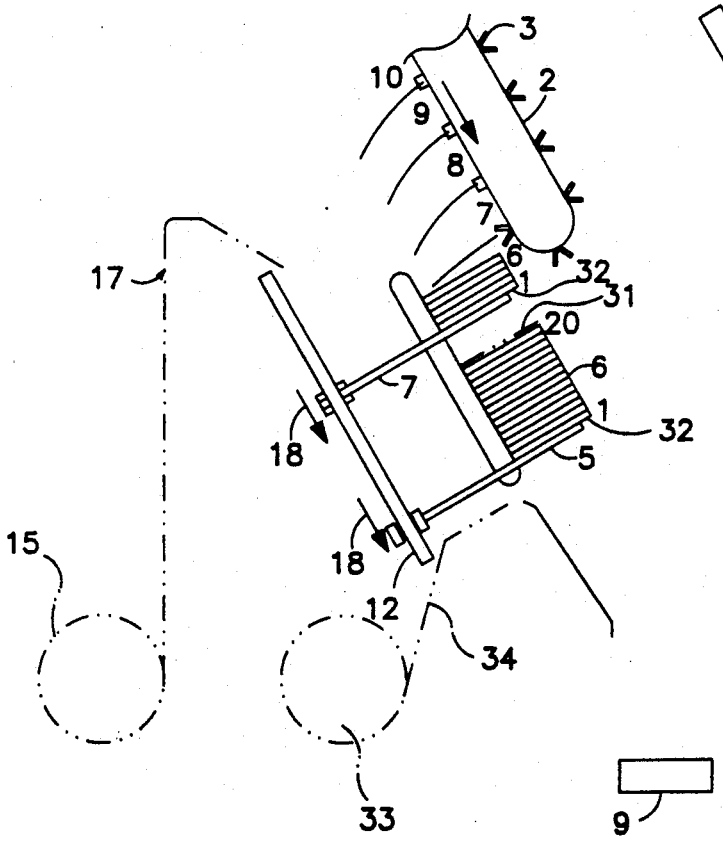
Figure 5B:
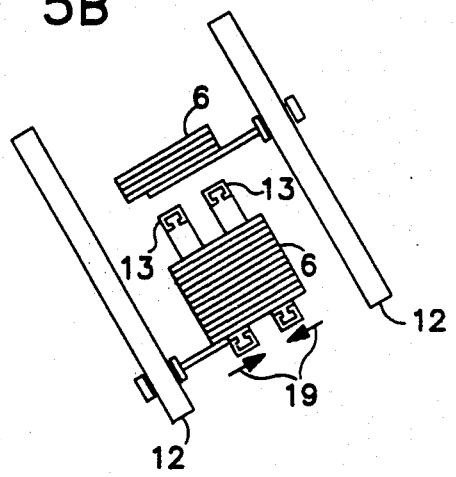
Figure 6A:
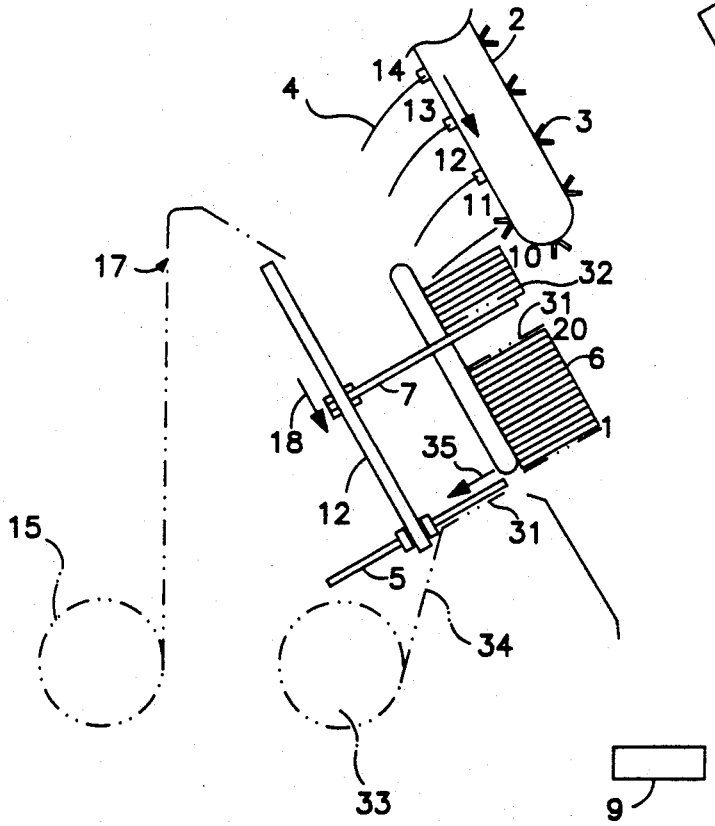
Figure 6B:
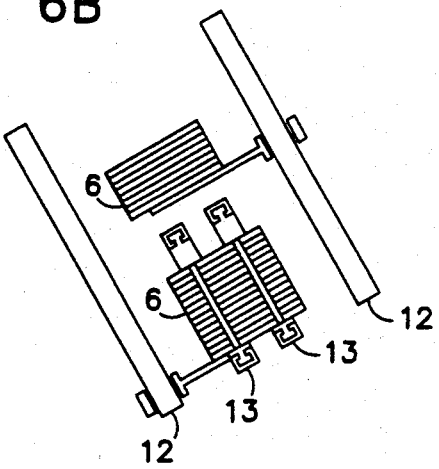

In FIGS. 5, strapping frames 13 have moved in the direction of arrows 19 and are also moving downstream at the same speed as bundle 6. As shown in FIG. 5B, they are in position to strap bundle 6. FIG. 6 is one step further in the process.

Figure 7A:
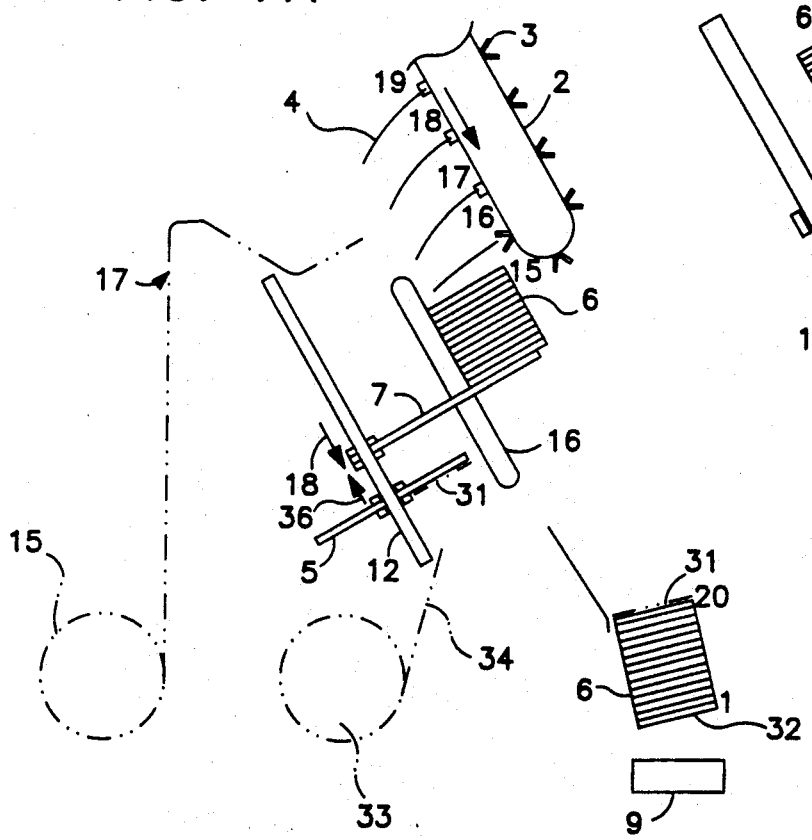
Figure 7B:
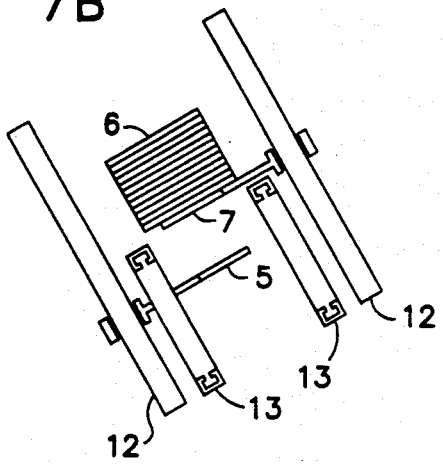

In FIGS. 7, strapping frames 13 have separated from bundle 6 and are moving upstream to their starting position. A new bundle is supported by second blades 7 and first blades 5 are returning to their initial position. At the same time, completed and strapped bundle 6 is discharged onto discharge conveyor 9. In FIG. 8, the cycle has begun once again.

FIG. 9 show a further preferred embodiment of the present invention. In addition to the elements previously described, a further pair of strapping frames 20 are provided. In order to speed up the operation, as can be seen in FIG. 9B, strapping frames 13 are in operative position and moving downstream as shown by arrows 22. Frames 20 have separated by moving in the directions of arrows 23 and are moving upstream in the direction of arrow 24. Thus, they will pass outside of frames 13 and return to the starting position ready to strap the next bundle being formed. Frames 13 follow the same cycle. In this manner, a high speed throughput can be obtained without excessive speed being required from the elements of the device.

Figure 10:
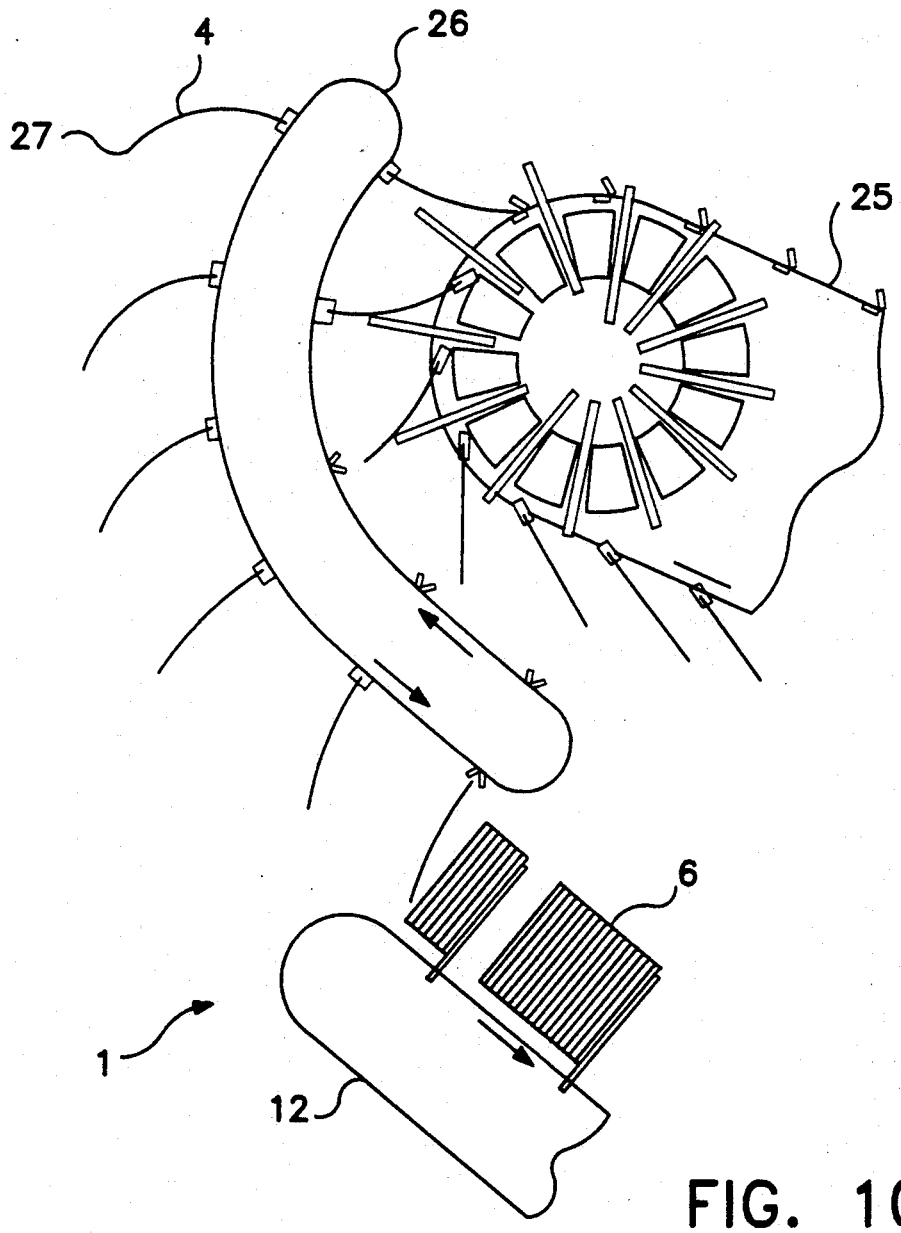
FIG. 10 is a schematic plan view, with parts omitted for clarity, showing release of the papers from a drum conveyor through an intermediate conveyor.

In FIG. 10, drum conveyor 25, which holds the papers by their folded edges, transfers papers 4 to intermediate conveyor 26. In this device, folded edge 27 leads and is easily deposited on the support conveyor (not shown) to form bundle 6.

Figure 11:
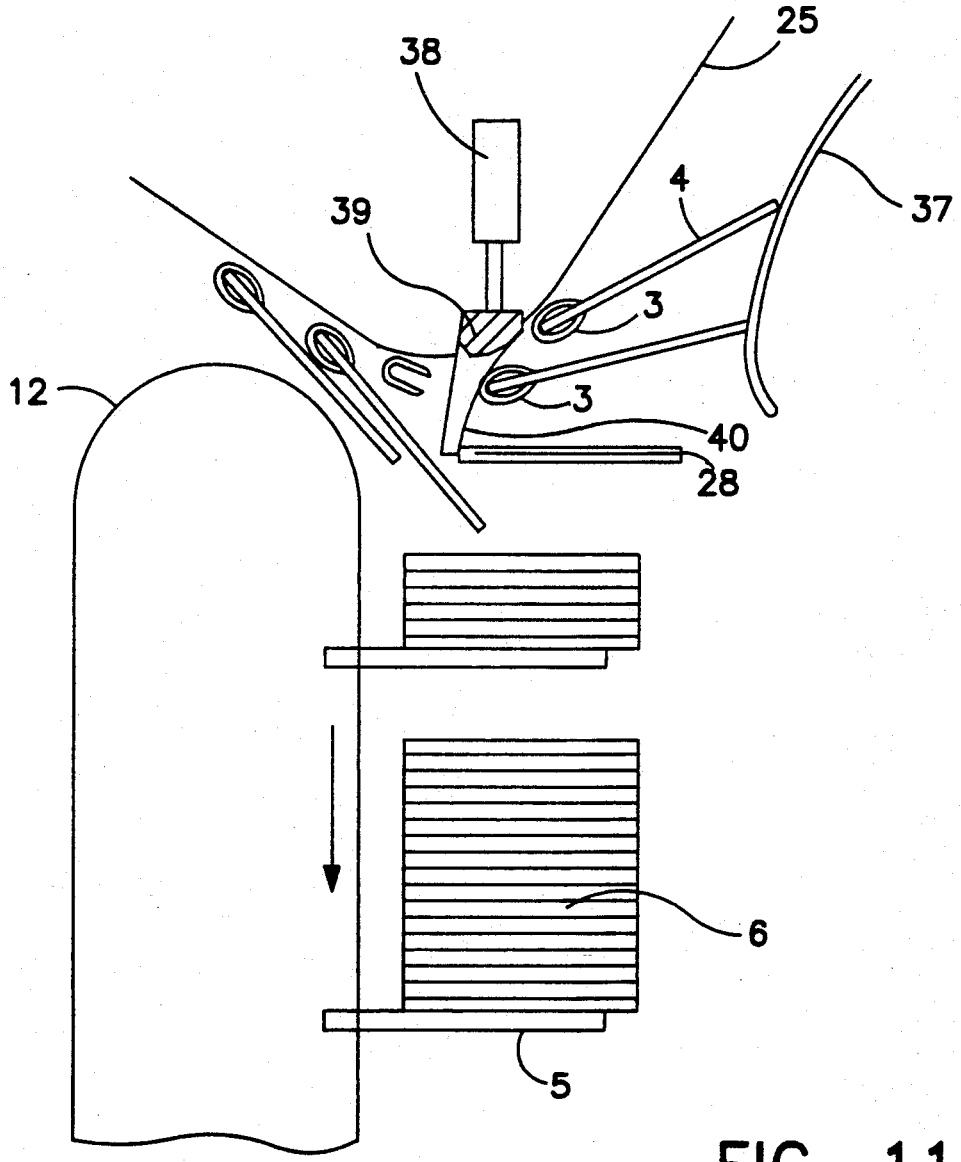
FIG. 11 is a schematic, similar to that of FIG. 10 showing release of the papers directly from a conveyor which holds the papers by their folded edges.

Referring more specifically to FIG. 11, news grip conveyor 25 carries grippers 3 which hold papers 4 by their folded edge. Open edge 28 is remote therefrom. In this form of the device, it is necessary to drop paper 4 onto the support conveyor by releasing from above. However, due to the configuration of conveyor 25 and the point in its travel at which papers 4 must be released, opening grippers 3 does nor always permit papers 4 to fall out onto stack 6. It is therefore sometimes advisable to provide cylinder 38 which actuates ejector 39 having cam surface 40. Cam surface 40 presses against the folded edge of papers 4 and forces them out of gripper 3 onto stack 6. Paper guide 37 assists in controlling the position of open edge 28 so that paper 4 lands flat and in proper position on bundle 6. The additional weight which is concentrated at the folded edge assists in this process.

In order to achieve high speed operation of the bundling device without excessive speed of its parts, a plurality of bundling devices is provided along each newsgrip conveyor 25. For example, if there are three such bundling devices, cylinder 38 is actuated every third gripper 3 so that one third of the delivery volume of newsgrip conveyor 25 is received by the bundling device shown. Each of the other two will receive one of the remaining papers. In the foregoing manner, a very high speed delivery from conveyor 25 can be accommodated without undue speed on the part of the bundling devices.

In another modification, a complete bundle can be received by one bundling device, a second bundle by a second bundling device, and a third bundle by a third bundling device. This will permit the handling equipment which is downstream of the bundlers to move more slowly while continuing to handle the full load of papers being processed.

Figure 12A:
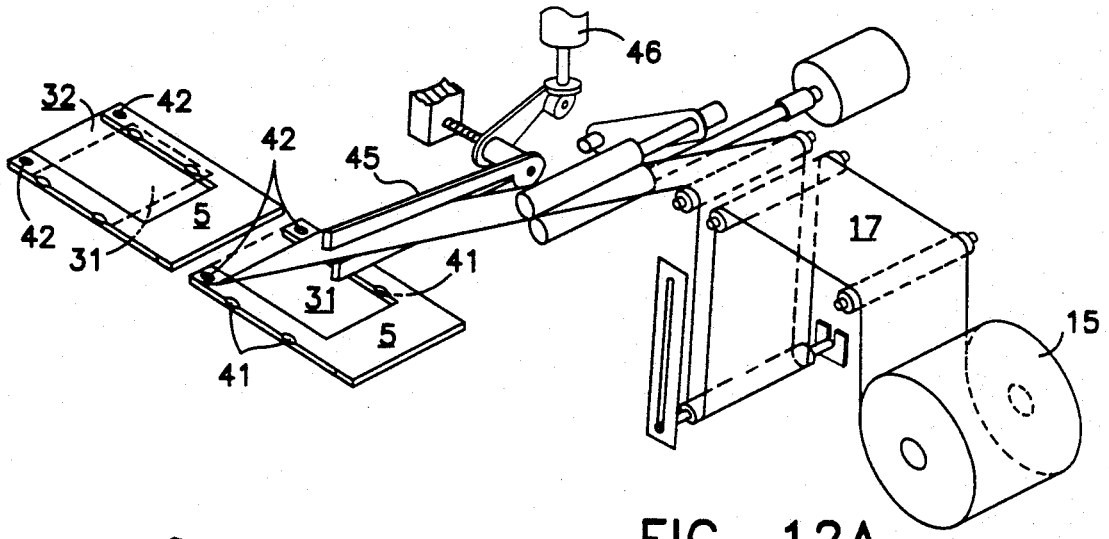
FIGS. 12A & 12B are schematic perspective views, with parts omitted for clarity, of the feed mechanisms for the top and bottom protective sheets.
Figure 12B:
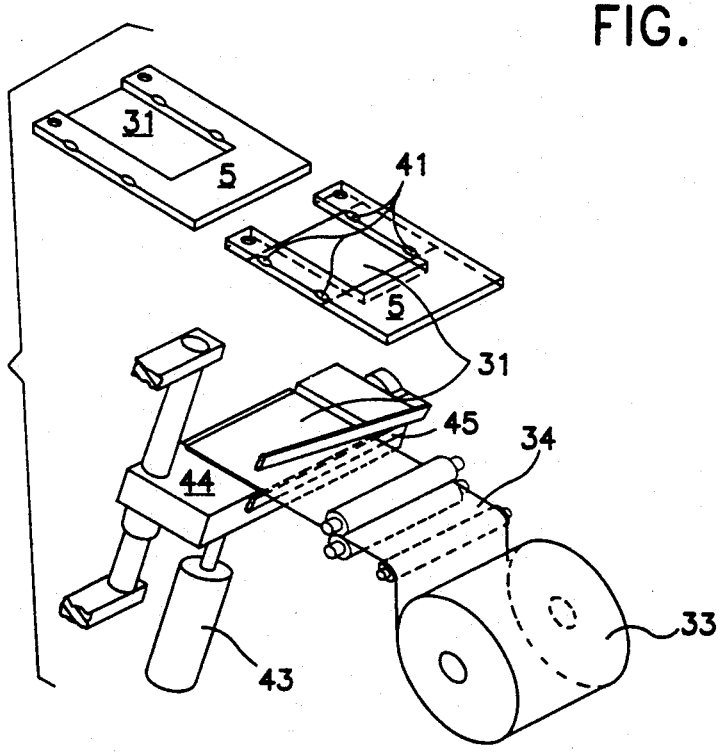

The application of the top and bottom protective sheets is shown in detail in FIGS. 12A and 12B. When blade 5 is withdrawn from contact with bundle 6 (see FIGS. 7), sheet 31 is fixed as shown in FIG. 12B. Roll 33 through feed 34 delivers the paper to tray 44. When the correct amount has been measured out, cutter 45 cuts top sheet 31 so that it rests on tray 44. Actuator 43 raises tray 44 to the underside of blade 5 where it is retained by vacuum cups 41.

Blade 5 continues in its cycle to the position shown in FIG. 12A. At this point, roll 15, through bottom feed 17 delivers the protective paper to cutter 45 which, when actuated by cutter cylinder 46, severs feed 17 to produce bottom sheet 32. Since blade 5 is beneath cutter 45 and sheet 32 at the time of severance, it falls by gravity onto the supper surface of blade 5. Vacuum cups 42 retain it in position.

The application of sheets 31 and 32 to bundle 6 is shown in FIGS. 3 to 8. In FIG. 3A, blade 7 is ready to begin its cycle, having both sheets 31 and 32 fixed thereon by vacuum cups 41 and 42 (not shown in FIG. 3A). In FIG. 4A, blade 7 is about to release top sheet 31 from its lower surface so that it can fall onto the top of bundle 6. At the same time, the first papers 4 forming the next bundle is deposited on bottom sheet 32 which rests on the upper surface of blade 7. In FIGS. 5, bundle 6 has moved away from blade 7 and strapping frames 13 are in position to apply the straps to secure bundle 6 with protective sheets 31 and 32 at the top and bottom thereof.

As shown in FIGS. 6, strapping has been completed and bundle 6 is being ejected onto discharge conveyor 9. Blade 5 moves in the direction of arrow 35 and top sheet 31 is applied to its underside as shown in FIG. 12B.

Figure 8A:
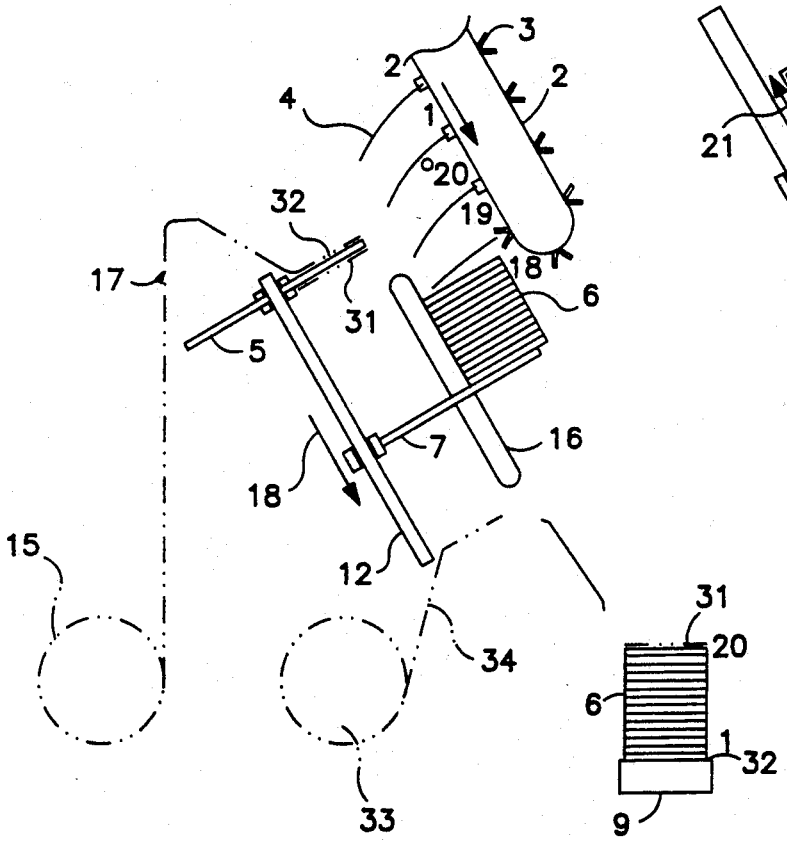
Figure 8B:
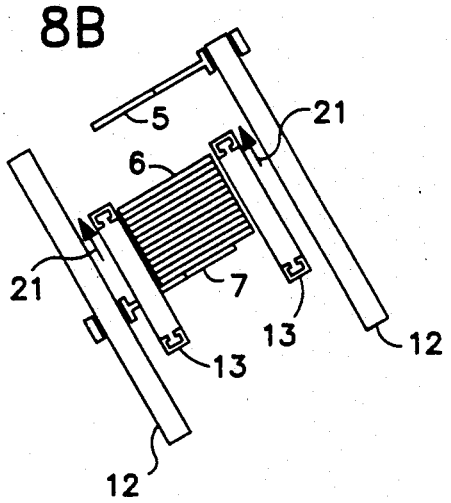

Blades 5 then moves toward its starting position in the direction of arrow 36 (see FIG. 7A) and, when it reaches the position shown in FIG. 8A, bottom sheet 32 is applied in accordance with FIG. 12A. This completes the cycle.

While only a limited number of specific embodiments of the present invention have been expressly disclosed, it is, nonetheless, to be broadly construed, and not to be limited except by the character of the claims appended hereto.

I claim:

1. A device for bundling a plurality of flat flexible non-self-supporting structures received serially from at least one feed conveyor, said device comprising a support conveyor adjacent said feed conveyor and movable in a downstream direction along a path, a first conveyor movable in said downstream direction adjacent said support conveyor, at least one first blade on said first conveyor movable in a perpendicular direction toward said support conveyor to a support position wherein said first blade acts as a rest for said structures, said first blade also movable away from said support conveyor to an inoperative position out of said path, said first blade, when in said support position, advancing in said downstream direction as said structures are deposited on edge onto said support conveyor, whereby a bundle of said structures is formed.

2. The device of claim 1 further comprising an applicator for applying at least one of a first protective sheet and a second protective sheet to said bundle.

3. The device of claim 1 wherein there is a plurality of said first blades spaced apart in said downstream direction on said first conveyor.

4. The device of claim 1 comprising a second conveyor movable in said downstream direction adjacent said first conveyor and said support conveyor, at least a second blade on said second conveyor movable in said perpendicular direction to said support position wherein said second blade acts as a rest for said structures, said second blade movable away from said support conveyor to said inoperative position wherein said second blade is out of said path, said second blade, when in said support position, advancing in said downstream direction as said structures are deposited on edge by said feed conveyor on to said support conveyor, whereby a bundle of said structures is formed.

5. The device of claim 4 wherein said second blade enters said path alternately with said first blade.

6. The device of claim 4 wherein there is a plurality of said second blades spaced apart in said downstream direction on said second conveyor.

7. The device of claim 5 wherein there is a plurality of said second blades spaced apart in said downstream direction on said second conveyor.

8. The device of claim 4 wherein said first conveyor is at an angle to said support conveyor of 0° to about 45°.

9. The device of claim 1 wherein there is a discharge conveyor adjacent the downstream end of said support conveyor, said discharge conveyor receiving said bundles and conveying them to a location remote from said device.

10. The device of claim 1 wherein said first conveyor is at an angle to said support conveyor of 0° to about 45°.

11. The device of claim 1 wherein said structures have folded edges and open edges, and said feed conveyor holds said structures by said folded edges.

12. The device of claim 1 wherein said structures have folded edges and open edges, and said feed conveyor holds said structures by said open edges.

13. The device of claim 1 wherein said plurality of structures is shingled.

14. A method of forming a bundle from a plurality of flat flexible non self-supporting structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle.

15. The method of claim 14 wherein said first blade, when said bundle is complete, moving out of said path and in an upstream direction opposite to said downstream direction.

16. The method of claim 15 wherein said first blade moves in said upstream direction to said initial position.

17. The method of claim 14 further comprising moving at least one subsequent blade toward said support conveyor into said support position, moving said second blade, while in said support position, in said downstream direction at said forming speed, said first blade and said second blade alternating in moving into said support position.

18. The method of claim 14 comprising applying at least one of a first protective sheet and a second protective sheet to said bundle.

19. The method of claim 14 wherein said structures have folded edges and open edges, and said feed conveyor holds said structures by said folded edges.

20. The method of claim 14 wherein said structures have folded edges and open edges, and said feed conveyor holds said structures by said open edges.

21. The method of claim 14 wherein said plurality of structures is shingled.

22. A method of forming a bundle from a plurality of flat flexible structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle, when said bundle is complete, moving a first pair of strapping frames located on either side of said bundle in said downstream direction from a starting position at said forming speed and moving said first pair inwardly in a strapping direction to a strapping position surrounding portions of said bundle, and strapping said bundle.

23. The method of claim 22 wherein, when said bundle in complete. moving a second pair of strapping frames located on either side of said bundle in said downstream direction from said starting position at said forming speed and moving said second pair inwardly in said strapping direction to said strapping position, and strapping said bundle.

24. The method of claim 23 comprising moving said second pair in an opposite direction to said strapping direction to a separated position, thereby releasing said bundle.

25. The method of claim 24 comprising moving said second pair in an upstream direction opposite to said downstream direction while said second pair is in said separated position.

26. The method of claim 25 comprising moving said first and second pairs in said upstream direction at a return speed greater than said forming speed.

27. The method of claim 25 comprising causing said first and second pairs to pause at said starting position.

28. The method of claim 25 wherein said second pair moves in said upstream direction to said starting position.

29. The method of claim 28 wherein said first pair and said second pair move alternately into said strapping position.

30. The method of claim 29 comprising, when said first pair is in said strapping position and moving in said downstream direction, moving said second pair in said upstream direction in said separated position and, when said second pair is in said strapping position and moving in said downstream direction, moving said first pair in said upstream direction in said separated position.

31. The method of claim 22 further comprising moving said first pair in an opposite direction to said strapping direction to a separated position, thereby releasing said bundle.

32. The method of claim 31 further comprising moving said first pair in an upstream direction opposite to said downstream direction while said first pair is in said separated position.

33. The method of claim 32 comprising moving said first pair in said upstream direction to said starting position.

34. A device for bundling a plurality of flat flexible structures received serially from a feed conveyor, said device comprising a support conveyor adjacent said feed conveyor and movable in a downstream direction along a path, a first conveyor movable in said downstream direction adjacent and substantially parallel to said support conveyor, at least one first blade on said first conveyor movable in a perpendicular direction toward said support conveyor to a support position wherein said first blade acts as a rest for said structures, said first blade also movable away from said support conveyor to an inoperative position out of said path, said first blade, when in said support position, advancing in said downstream direction as said structures are deposited on edge onto said support conveyor, whereby a bundle of said structure is formed, a first pair of strapping frames, one on either side of said bundle, movable in said downstream direction from a starting position and in an upstream direction opposite thereto, said first pair also movable in a strapping direction toward said bundle to a strapping position surrounding portions of said bundle and in an opposite direction to an opposite position clear of said bundle, when said bundle is complete, said first pair moving in said downstream direction from said starting position at a speed substantially equal to that of said bundle, said first pair also moving in said strapping direction to said strapping position to strap said bundle, thereafter moving in said opposite direction clear of said bundle, and then moving in said upstream direction to said starting position.

35. The device of claim 34 comprising a second pair of strapping frames, one on either side of said bundle, movable from said starting position in said downstream direction and in said upstream direction, said second pair also movable in said strapping direction to said strapping position and in said opposite direction to said opposite position, when said bundle is complete, said second pair moving in said downstream direction from said starting position at said speed, said second pair also moving in said strapping direction to said strapping position to strap said bundle, thereafter moving in said opposite direction to said opposite position, then moving in said upstream direction to said starting position, when said first pair is in said strapping position and moving in said downstream direction, said second pair is in said opposite position and moving in said upstream direction, when said second pair is in said strapping position and moving in said downstream direction, said first pair is in said opposite position and moving in said upstream direction.

36. A method of forming a bundle from a plurality of flat flexible structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle, said first blade, when said bundle is complete, moving out of said path and in an upstream direction opposite to said downstream direction, moving said first blade in said upstream direction at a return speed which is faster than said forming speed.

37. A method of forming a bundle from a plurality of flat flexible structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle, said first blade, when said bundle is complete, moving out of said path and in an upstream direction opposite to said downstream direction, said first blade pausing at said initial position.

38. A method of forming a bundle from a plurality of flat flexible structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle, a first applicator, for applying a first protective sheet, and a second applicator, for applying a second protective sheet, to said bundle.

39. The device of claim 38 further comprising a second source of said second sheet, a second feed mechanism for supplying said second sheet to a position adjacent a second face of said first blade, a second vacuum element on said second face adapted to retain said second sheet in contact with said second face.

40. The device of claim 39 wherein said second source is a roll of second protective paper and said second feed mechanism includes a second cutter adapted to cut said second protective paper to form said second sheet.

41. A device for bundling a plurality of flat flexible structures received serially from a feed conveyor, said device comprising a support conveyor adjacent said feed conveyor and movable in a downstream direction along a path, a first conveyor movable in said downstream direction adjacent and substantially parallel to said support conveyor, at least one first blade on said first conveyor movable in a perpendicular direction toward said support conveyor to a support position wherein said first blade acts as a rest for said structures, said first blade also movable away from said support conveyor to an inoperative position out of said path, said first blade, when in said support position, advancing in said downstream direction as said structures are deposited on edge onto said support conveyor, whereby a bundle of said structure is formed, an applicator for applying at least one of a first protective sheet and a second protective sheet to said bundle, a first source of said first sheet, a first feed mechanism for supplying said first sheet to a position adjacent a first face of said first blade, a first vacuum element on said first face adapted to retain said first sheet in contact with said first face.

42. The device of claim 41 wherein said first source is a roll of first protective paper and said first feed mechanism includes a first cutter adapted to cut said first protective paper to form said first sheet.

43. The device of claim 41 wherein said feed mechanism includes a tray adapted to receive said first sheet and an actuator adapted to move said tray to said position.

44. A device for bundling a plurality of flat flexible structures received serially from a feed conveyor, said device comprising a support conveyor adjacent said feed conveyor and movable in a downstream direction along a path, a first conveyor movable in said downstream direction adjacent and substantially parallel to said support conveyor, at least one first blade on said first conveyor movable in a perpendicular direction toward said support conveyor to a support position wherein said first blade acts as a rest for said structures, said first blade also movable away from said support conveyor to an inoperative position out of said path, said first blade, when in said support position, advancing in said downstream direction as said structures are deposited on edge onto said support conveyor, whereby a bundle of said structure is formed, said support conveyor being at a conveyor angle which is closer to vertical than to horizontal.

45. A method of forming a bundle from a plurality of flat flexible structures delivered serially by a feed conveyor, said method comprising depositing said structures on edge onto a support conveyor moving in a downstream direction along a path, moving a first blade from an initial position toward said support conveyor into a support position wherein said first blade acts as a rest for said structures, moving said first blade, while in said support position, in said downstream direction at a forming speed which is substantially the same as that of said bundle, said support conveyor being at a conveyor angle which is closer to vertical than to horizontal.

* * * * *